US009068753B2

(12) United States Patent
Trautner et al.

(10) Patent No.: US 9,068,753 B2
(45) Date of Patent: Jun. 30, 2015

(54) DOOR FOR DOMESTIC APPLIANCE AND DOMESTIC APPLIANCE

(75) Inventors: Andreas Trautner, Neuendettelsau (DE); Markus Schmid, Abtsgmund (DE)

(73) Assignee: ELECTROLUX HOME PRODUCTS CORPORATION N.V., Brussels (BE)

( * ) Notice: Subject to any disclaimer, the term of this patent is extended or adjusted under 35 U.S.C. 154(b) by 0 days.

(21) Appl. No.: 13/583,968

(22) PCT Filed: Mar. 29, 2011

(86) PCT No.: PCT/EP2011/001565

§ 371 (c)(1), (2), (4) Date: Sep. 11, 2012

(87) PCT Pub. No.: WO2011/120670

PCT Pub. Date: Oct. 6, 2011

(65) Prior Publication Data

US 2013/0014742 A1 Jan. 17, 2013

(30) Foreign Application Priority Data

Mar. 31, 2010 (EP) ..... 10003575

(51) Int. Cl.
*F24C 15/04* (2006.01)
*F24C 15/02* (2006.01)

(52) U.S. Cl.
CPC ..... *F24C 15/024* (2013.01)

(58) Field of Classification Search
CPC ..... F24C 15/024
USPC ..... 126/19 R, 190, 198, 200
See application file for complete search history.

(56) References Cited

U.S. PATENT DOCUMENTS

| | | | | |
|---|---|---|---|---|
| 5,255,473 | A * | 10/1993 | Kaspar et al. | 49/501 |
| 5,379,925 | A * | 1/1995 | Mothrath et al. | 222/475.1 |
| 6,054,699 | A * | 4/2000 | Kim et al. | 219/756 |
| 2006/0141197 | A1 * | 6/2006 | Caparros Taracido et al. | 428/40.1 |
| 2010/0139638 | A1 * | 6/2010 | Hargrave et al. | 126/19 R |

FOREIGN PATENT DOCUMENTS

| | | |
|---|---|---|
| DE | 19624601 | 6/1997 |
| DE | 20111406 | 10/2001 |
| EP | 1179712 | 2/2002 |
| EP | 1653156 | 5/2006 |
| EP | 2090832 | 8/2009 |

OTHER PUBLICATIONS

International Search Report for PCT/EP2011/001565, dated May 13, 2011, 3 pages.

* cited by examiner

*Primary Examiner* — Kenneth Rinehart
*Assistant Examiner* — Gajanan M Prabhu
(74) *Attorney, Agent, or Firm* — Pearne & Gordon LLP

(57) ABSTRACT

Door for a domestic appliance, in particular an oven door, having a front glass (10; 40) and a handle (12; 42) for opening and closing the door, wherein the handle (12; 42) is attached to the front glass (10; 40) by means of an adhesive without any additional fixing means.

17 Claims, 4 Drawing Sheets

DOOR FOR DOMESTIC APPLIANCE AND DOMESTIC APPLIANCE

TECHNICAL FIELD

The present invention relates to a door for a domestic appliance, in particular an oven door, having a front glass and a handle for opening and closing the door.

Doors of the above-mentioned kind are already known in the art. The handles of such doors are normally attached to the door by means of screws or other fixing elements, what leads to a high number of components. Moreover, the fixing elements need to be covered after the assembly in order to achieve a good appearance, so that a complex design is created.

Starting from this prior art it is an object of the present invention to provide a door of the above-mentioned kind, which has a low number of components, has a simple construction and is thus easy to manufacture and to assemble.

In order to solve this object the present invention provides a door of the above-mentioned kind, which is characterized in that the handle is attached to the front glass by means of an adhesive without any additional fixing means. Accordingly, no screws or other fixing elements are needed, such that the number of components is low. This leads to a door of a simple design, which is easy to manufacture and to assemble.

According to one embodiment of the present invention the handle comprises a base portion, whose rear side rests on the front glass, and a hand piece provided at the front side of the base portion, wherein the rear side of the base portion is provided with at least one pocket receiving the adhesive. Such a pocket ensures a defined gluing line and/or a defined adherend, whereby the assembly of the door is simplified.

Preferably, the pocket has a defined depth in order to define the quantity and/or the height of the adhesive layer needed for an orderly attachment of the handle.

Advantageously, the pocket essentially extends along the entire width of the base portion, what leads to a uniform, strong and permanent fixation of the handle.

According to one embodiment of the present invention the door is provided with at least one decoration element, in particular a decoration strip, which is made of a three dimensionally formed sheet-material, such as a sheet of rigid plastic material, stainless steel, aluminium or the like, and which is attached to the front glass. The decoration element functions as a facing giving the front side of the door a more three dimensional appearance. Moreover, the decoration element can serve as a protection against direct contact with the front glass.

The handle and the decoration element preferably together define essentially a U-form framing the front glass.

According to one embodiment of the present invention, the at least one decoration element is attached to the front glass by means of at least one spacer, which bridges the space between the front glass and the decoration element.

Preferably, the at least one spacer is attached to the front glass by means of an adhesive. For this purpose the at least one spacer can also be provided with at least one pocket receiving the adhesive.

Moreover, the at least one decoration element is preferably attached to the at least one spacer by means of an adhesive.

According to one aspect of the present invention, the at least one spacer is made integral with the handle, wherein the handle and the spacers preferably together define a U-shape.

As an adhesive, a two-component adhesive and/or a double-sided adhesive tape can be used to name only a few possibilities.

Moreover, the present invention provides a domestic appliance, in particular an oven, comprising a door of the above-defined kind.

Further features and advantages will become apparent on the basis of the following description of preferred embodiments of the door according to the present invention with reference to the accompanying drawing. In the drawing FIG. 1 is a front view of a front glass of a door according to a first embodiment of the present invention;

Figure 2:
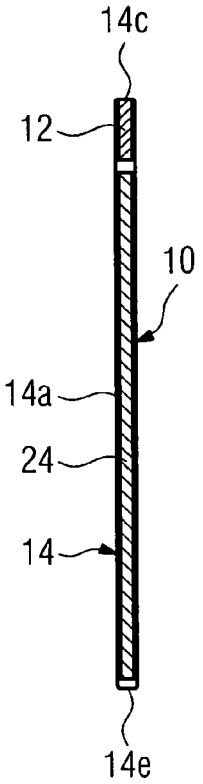
FIG. 2 is a sectional view along the line II-II in FIG. 1.
Figure 1:
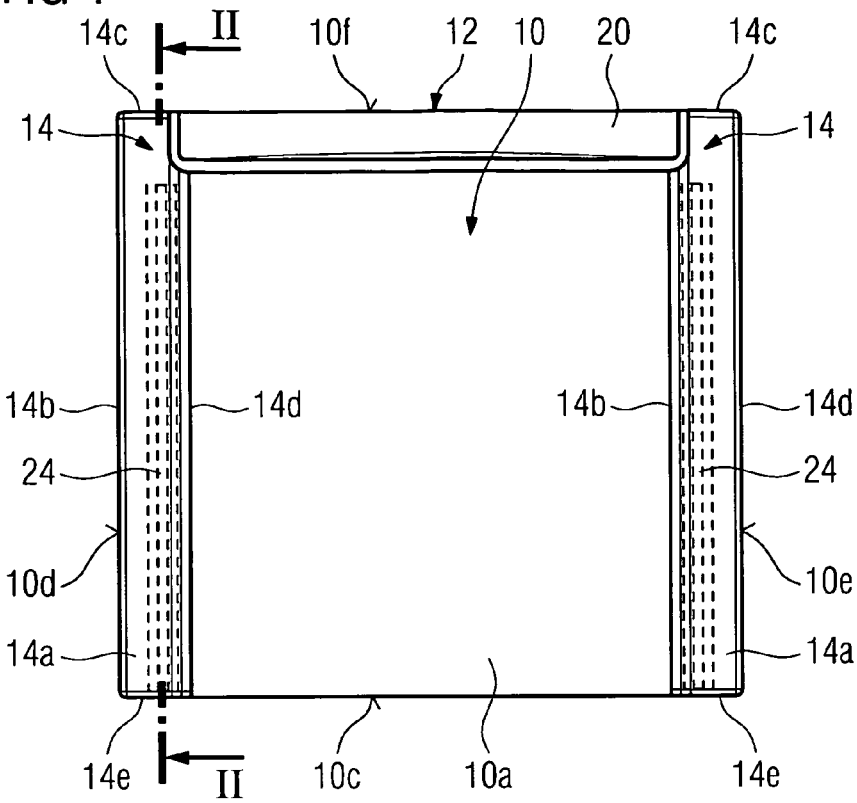
Figure 3:
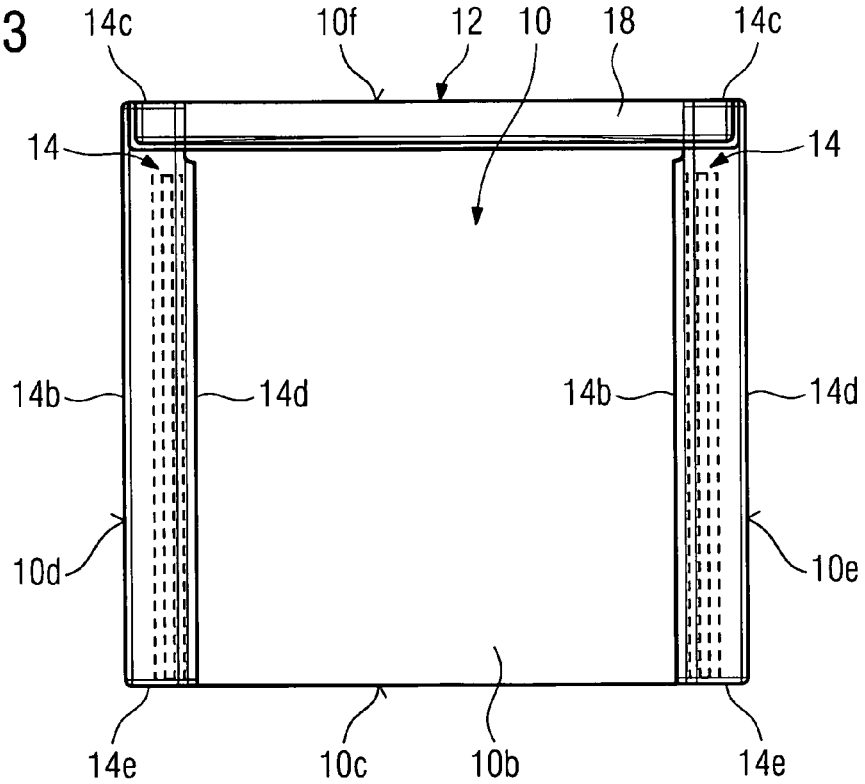
FIG. 3 is a rear view of the front glass shown in FIGS. 1 and 2.

FIGS. 1 to 3 show a front glass 10 of a door according to a first embodiment of the present invention. The front glass 10 has a square form and comprises a front side 10*a*, a rear side 10*b*, a lower edge 10*c*, two side edges 10*d* and 10*e* as well as an upper edge 10*f*. Attached to the front side 10*a* of the front glass 10 are a handle 12 and two decoration elements 14 by means of an adhesive.

Figure 4:
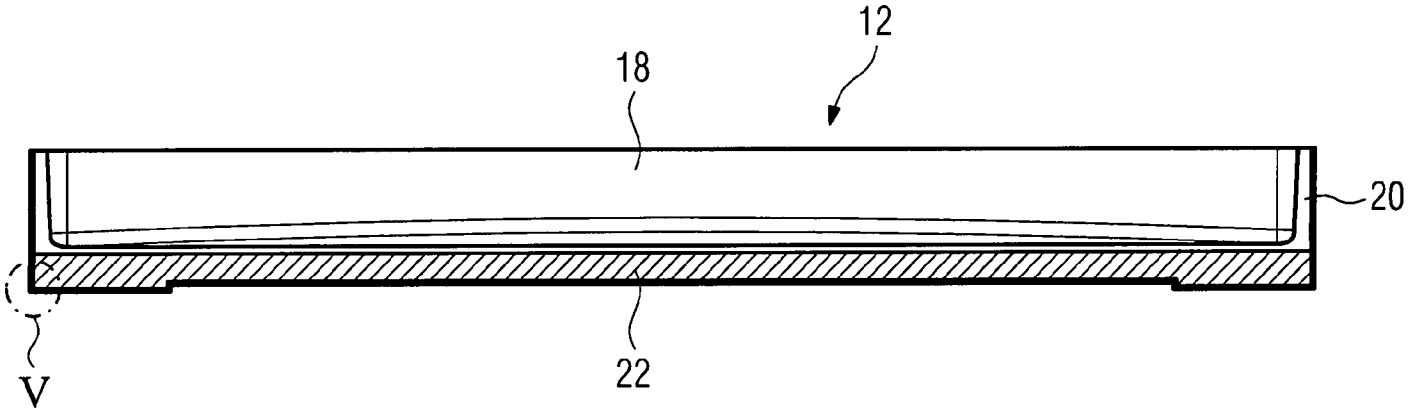
FIG. 4 is an enlarged front view of a handle attached to the front glass shown in FIGS. 1 to 3.
Figure 5:
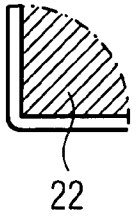
FIG. 5 is an enlarged view of the section V in FIG. 4.

The handle 12, which is shown in more detail in FIGS. 4 and 5, extends along the upper edge 10*f* of the front glass 10 and comprises a base portion 18, which rests on the front side 10*a* of the front glass 10, and an essentially U-shaped hand piece 20, which projects from the base portion 18 and can be gripped by a user. The rear side of the base portion 18 is provided with a pocket 22 for receiving the adhesive necessary for gluing the handle 12 on the front glass 10. The pocket 22 has a defined depth and essentially extends over the whole width of the base portion 18 along the lower edge of the handle 12.

The decoration elements 14 both have a rectangular shape and are made of a three dimensionally formed sheet-material. Each decoration element 14 defines a rectangular main surface 14*a*, which is spaced apart from the front side 10*a* of the front glass 10, as well as side edges 14*b, c, d, e*, which are chamfered towards the front side 10*a* of the front glass 10. The decoration elements 14 extend over the entire height of the front glass 10 along its side edges 10*d* and 10*e*, such that the handle 12 and the decoration elements 14 together define a U-form framing the front glass 10.

In order to attach the decoration elements 14 to the front side 10*a* of the front glass 10, spacers 24 are provided. The spacers 24 are glued to the front glass 10, and the decoration elements 14 are glued to the spacers 24. The height of the spacers 24 is chosen in such a manner that the side edges 14*b, c, d, e* of the decoration elements 14 rest on the front glass 10.

During the assembly, the handle 12 and the spacers 24 are glued on the front side 10*a* of the front glass 10 at first. Thereupon, the decoration elements 14 are glued on the spacers 24. As an adhesive a two-component adhesive and/or a double-sided adhesive tape can be used, to name only a few possibilities.

FIGS. 6 to 10 show a front glass 40 of a door according to a second embodiment of the present invention. The front glass 40 has a square form and comprises a front side 40*a*, a back side 40*b*, a lower edge 40*c*, two side edges 40*d* and 40*e* as well as an upper edge 40*f*. Attached to the front side 40*a* of the front glass 40 are a handle 42 and two decoration elements 44 by means of an adhesive. The decoration elements 44 essentially correspond to the decoration elements 14 shown throughout FIGS. 1 to 3, wherefore their structure is not explained in detail once more.

Figure 7:
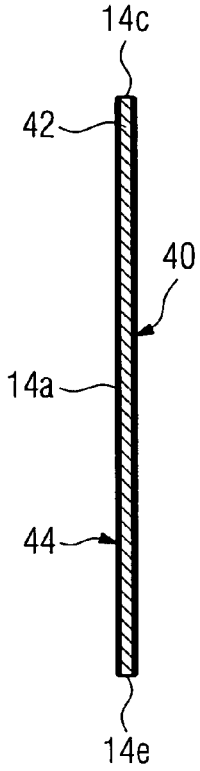
FIG. 7 is a sectional view along the line VII-VII in FIG. 6.
Figure 6:
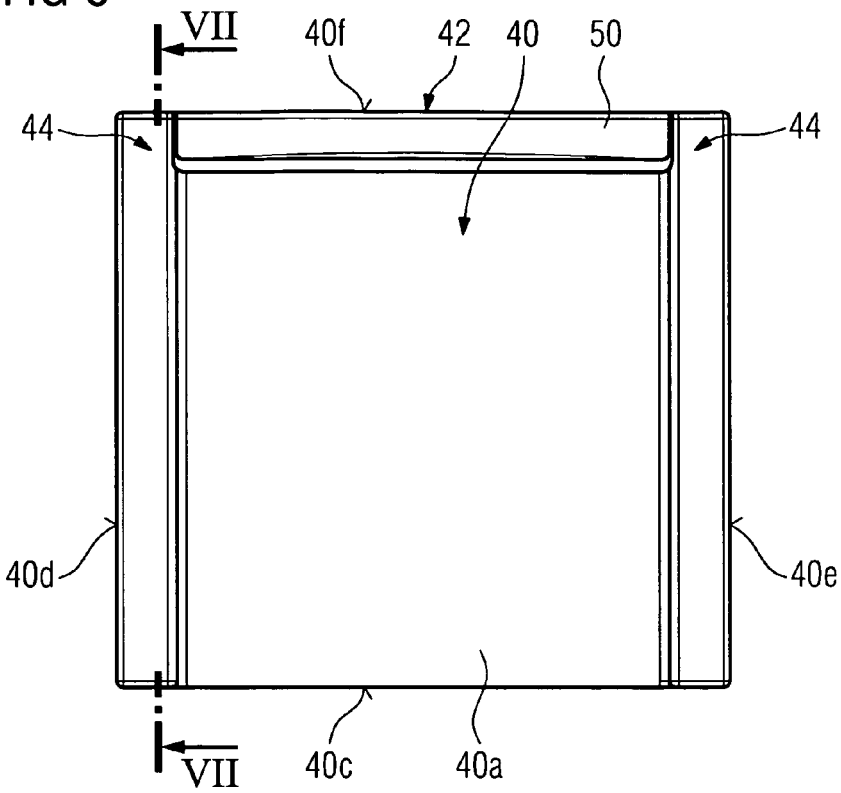
FIG. 6 is a front view of a front glass of a door according to a second embodiment of the present invention.
Figure 8:
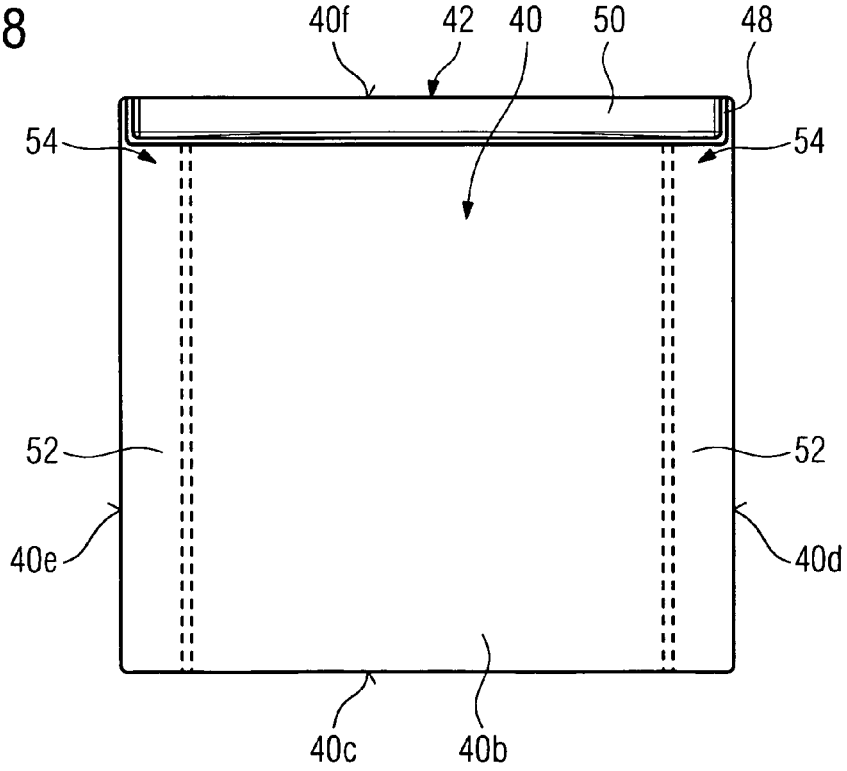
FIG. 8 is a rear view of the front glass shown in FIGS. 6 and 7.
Figure 9:
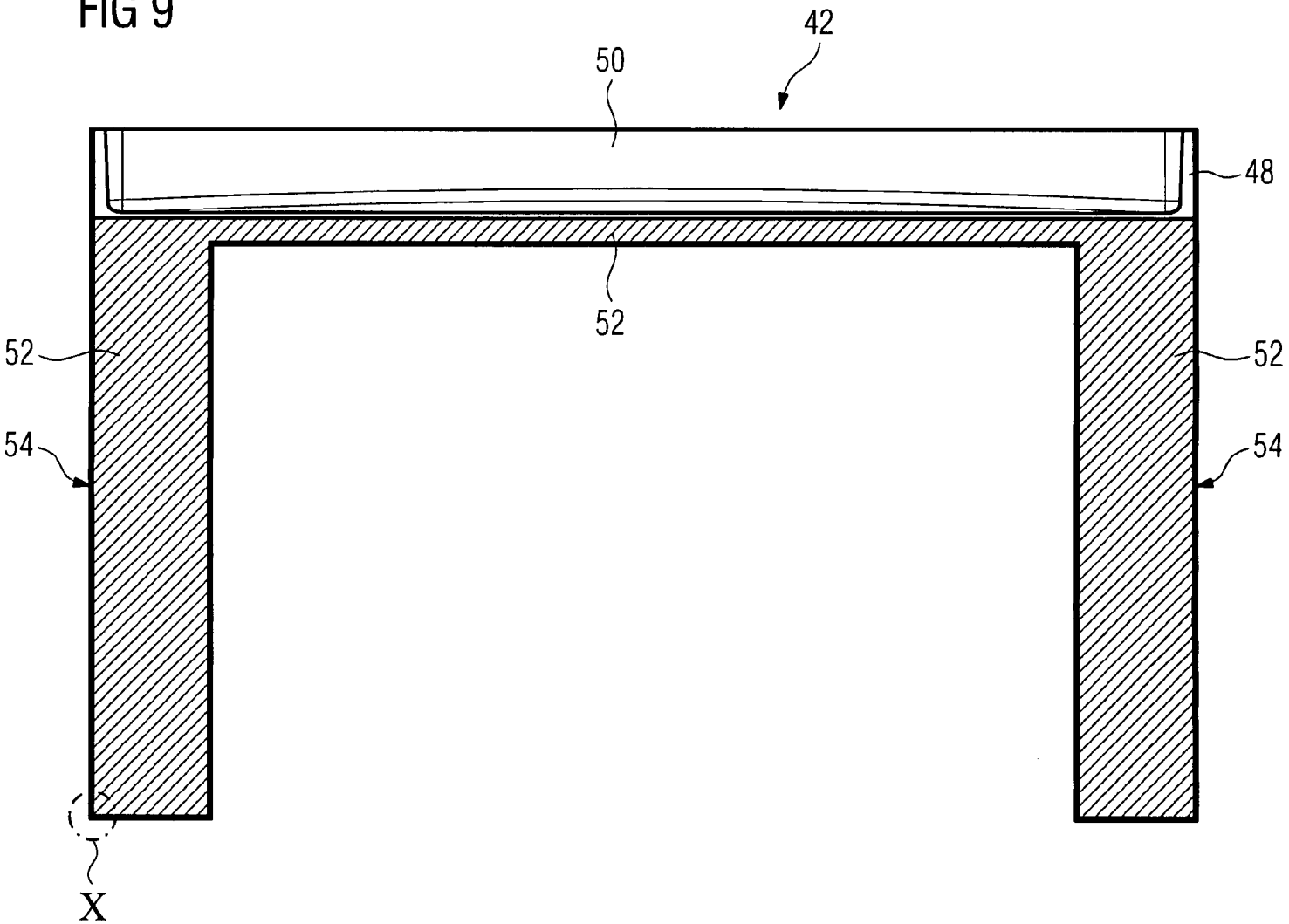
FIG. 9 is a schematic back view of a handle attached the front glass, which illustrates the dimensions of an adhesive receiving pocket.
Figure 10:
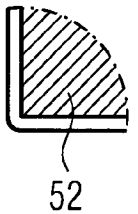
FIG. 10 is an enlarged view of the section X in FIG. 9.

The handle 42, as shown throughout the FIGS. 6 to 8, extends along the upper edge 40*f* of the front glass 40 and comprises a horizontally extending base portion 48, which rests on the front side 40*a* of the front glass 40, and an essentially U-shaped hand piece 20, which projects from the base portion 48 and can be gripped by a user. Integrally formed with the base portion 48 are two spacers 54, which downwardly project at the free ends of the base portion 48 to create an overall U-form framing the front glass 40. As it is shown in FIGS. 9 and 10, the rear sides of the base portion 48 and the spacers 54 of the handle 42 are provided with a pocket 52 for receiving the adhesive necessary for gluing the handle 42 or rather the spacers 54 on the front glass 40. The pocket 52 has a defined depth and essentially extends over the whole width of the base portion 48 along its lower edge as well as over the height of the spacers 54. The front side contour of the spacers 54 at least partially corresponds to the contour of the rear sides of the decoration elements 44, so that the decoration elements 44 can be easily glued on the spacers 54 in order to fix them at the front glass 40.

During the assembly, the handle 42 with the integral spacers 54 is glued on the front side 40*a* of the front glass 10 at first. Thereafter, the decoration elements 44 can be glued on the spacers 54. As an adhesive a two-component adhesive and/or a double-sided adhesive tape can be used to name only a few possibilities.

The above described front glass designs are of advantage in that they have a simple structure with a low number of components. Accordingly, they are easy to produce and to assemble. During the assembly, the pockets 22 and 52 ensure a defined gluing line, so that a proper work result is guaranteed.

The invention claimed is:

1. Door for a domestic appliance, having a front glass (10; 40) and a handle (12; 42) for opening and closing the door, characterized in that the handle (12; 42) comprises a base portion (18; 48), whose rear side rests on the front glass (10; 40), and a hand piece (20; 50) provided at the front side of the base portion (18; 48), wherein the rear side of the base portion (18; 48) is provided with at least one pocket (22; 52) receiving an adhesive, and that the handle (12; 42) is attached to the front glass (10; 40) by means of the adhesive without any additional fixing means, wherein the pocket (22; 52) has a defined depth defining the quantity or height of the adhesive.

2. Door according to claim 1, characterized in that the pocket (22; 52) essentially extends along the entire width of the base portion (18; 48) ensuring a uniform, strong and permanent fixation of the handle (12; 42).

3. Door according to claim 1, characterized in that the door is provided with at least one decoration element (14; 44), which is attached to the front glass (10; 40).

4. Door according to claim 3, characterized in that the handle (12; 42) and the decoration element (14; 44) together define essentially a U-shape framing the front glass (10; 40).

5. Door according to claim 3, characterized in that the at least one decoration element (14; 44) is attached to the front glass (10; 40) by means of at least one spacer (24; 54) for purposes of bridging the space between the front glass (10; 40) and the decoration element (14; 44), thereby providing user protection.

6. Door according to claim 5, characterized in that the at least one spacer (24; 54) is attached to the front glass (10; 40) by means of an adhesive.

7. Door according to claim 6, characterized in that a rear side of the at least one spacer (24; 54) is provided with at least one pocket (54) receiving the adhesive.

8. Door according to claim 5, characterized in that the at least one decoration element (14; 44) is attached to the at least one spacer (24; 54) by means of an adhesive.

9. Door according to claim 5, characterized in that the at least one spacer (54) is made integral with the handle (12; 42).

10. Door according to claim 8, characterized in that the handle (12; 42) and the spacers (24; 54) together define a U-shape.

11. Door according to claim 1, characterized in that the adhesive is provided as a double-sided adhesive tape.

12. Domestic appliance comprising a door according to claim 1.

13. Door according to claim 1, further comprising at least one decoration element (14; 44) in the shape of a strip attached to the front glass (10; 40) for protection against direct contact with the front glass (10; 40).

14. Door according to claim 1, wherein the at least one pocket (22; 52) receiving the adhesive ensures a defined gluing line.

15. Door according to claim 1, wherein the domestic appliance is an oven.

16. Door according to claim 1, wherein the at least one pocket contains the adhesive.

17. Door according to claim 1, wherein the adhesive is a flowable adhesive.

* * * * *